United States Patent [19]

Menzel

[11] Patent Number: 4,961,258

[45] Date of Patent: Oct. 9, 1990

[54] DECORATIVE COLUMN FOR HOUSING REQUIREMENTS AND SIMILAR PURPOSES AND A METHOD OF MANUFACTURING SUCH A COLUMN

[75] Inventor: Dietrich Menzel, Siegsdorf, Fed. Rep. of Germany

[73] Assignee: Menzel-Leuchten GmbH & Co. KG, Fed. Rep. of Germany

[21] Appl. No.: 338,082

[22] Filed: Apr. 14, 1989

[30] Foreign Application Priority Data

Apr. 14, 1988 [DE] Fed. Rep. of Germany ..... 3812426

[51] Int. Cl.[5] ..... E04C 3/36

[52] U.S. Cl. ..... 52/747; 52/728; 156/264

[58] Field of Search ..... 52/727, 728, 741, 747; 156/256, 264, 304.2, 312

[56] References Cited

U.S. PATENT DOCUMENTS

| | | | |
|---|---|---|---|
| 714,886 | 12/1902 | Fenwick, Jr. . | |
| 763,957 | 7/1904 | Buckley . | |
| 817,241 | 4/1906 | Green . | |
| 1,000,822 | 8/1911 | Kyle . | |
| 1,804,320 | 5/1931 | Cross . | |
| 2,398,190 | 4/1946 | Parkes | 52/727 X |
| 2,903,390 | 9/1959 | Kojima | 156/312 X |
| 3,131,792 | 5/1964 | Groneman | 52/727 X |
| 3,200,554 | 8/1965 | Goodman | 52/727 |
| 3,345,240 | 10/1967 | O'Herron | 156/264 X |
| 4,387,546 | 6/1983 | Kurita et al. . | |
| 4,673,453 | 6/1987 | Georgii | 156/264 X |

FOREIGN PATENT DOCUMENTS

| | | | |
|---|---|---|---|
| 885444 | 1/1981 | Belgium . | |
| 7532453 | 2/1976 | Fed. Rep. of Germany . | |
| 348209 | 4/1905 | France . | |
| 1397794 | 3/1965 | France . | |
| 2240990 | 3/1975 | France . | |
| 2444424 | 7/1980 | France . | |
| 1201820 | 8/1970 | United Kingdom | 52/728 |

*Primary Examiner*—Richard E. Chilcot, Jr.
*Assistant Examiner*—Jerrold D. Johnson
*Attorney, Agent, or Firm*—Sughrue, Mion, Zinn, Macpeak & Seas

[57] ABSTRACT

The invention refers to a decorative column, especially made of wood, which consists of a stack (1) of elements (3) cut out of plates or boards, the main surface of the stacking elements being placed perpendicular to the stacking axis (5) which coincides with the column axis. Such columns may be especially used as wainscoting of metal supports in buildings but also as support elements of table plates or simply as decorative objects.

2 Claims, 1 Drawing Sheet

DECORATIVE COLUMN FOR HOUSING REQUIREMENTS AND SIMILAR PURPOSES AND A METHOD OF MANUFACTURING SUCH A COLUMN

FIELD OF THE INVENTION

The invention relates to a decorative column for housing requirements and similar purposes. The column may be used as a supporting member or as a wainscoting of such a member or else it is only used for decoration purposes. In particular, the invention may be applied to wainscoting of steel supports in houses, but the invention may even be applied to solid or hollow columns supporting a table or a capital above a passageway.

BACKGROUND OF THE INVENTION

The wainscoting of steel supports in a building often presents a rectangular or square cross-section and consists in this case of four boards or panels made of wood, glass (mirrors) or concrete, which are mounted at right angles to each other and which form a box around the support. From the U.S. Pat. Nos. 714,886, 817,241 and 1,000,822, there are also known columns having a circular cross-section and being constituted by a plurality of individual elements extending over the entire length of the column and being made integral by gluing. Due to their complicated shape, these individual elements can only be manufactured at high expenses and by means of special tools. Thus, only a mass fabrication method results in a reasonable price for such columns.

The object of the invention is therefore to propose a column which can easily be manufactured by means of normal wood shaping tools and it should even be possible to produce a column having a structured surface, for example longitudinal or transversal grooves or a variable diameter (for example a trumpet-like support for a table). Moreover, it should be possible to be manufactured at a reasonable price as a prototype in accordance with a custom-made design.

SUMMARY OF THE INVENTION

According to the invention, this object is obtained by the fact that the column consists of a glued stack of stacking elements which are obtained by cutting out plates or boards and the main surfaces of which are perpendicular to the stacking axis, the latter coinciding with the column axis.

If a hollow column is to be manufactured, annular stacking elements are used. Such a column may be conceived to wainscot for example a steel profile support in such a way that it looks like a greek marble column. To this end, a hollow column is manufactured from annular stacking elements, and then this column is cut into two half-columns along a plane including the stack axis and finally these half-columns are re-assembled around the support and glued. The invention will now be described by means of some preferred embodiments and of the enclosed drawings.

DETAILED DESCRIPTION OF THE INVENTION

Figure 1:
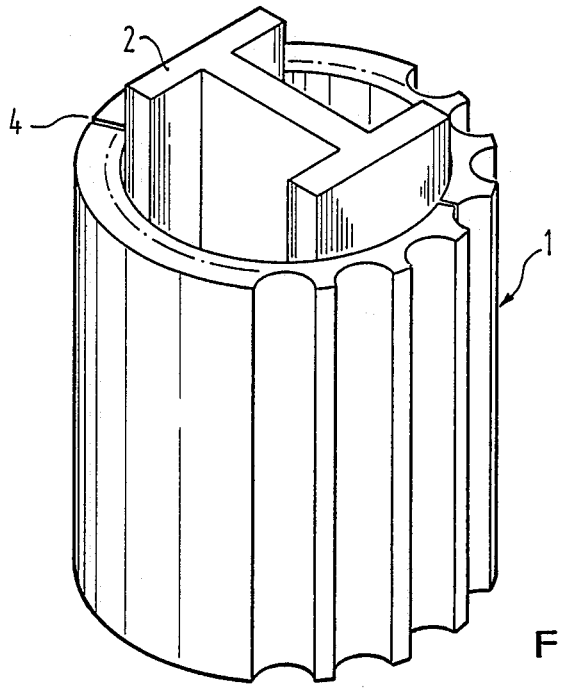
FIG. 1 shows schematically a wooden column made of annular stacking elements for use in wainscoting a steel support.
Figure 2:
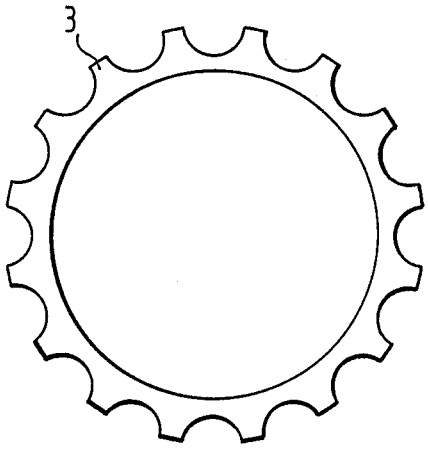
FIG. 2 shows from above one of the annular stacking elements of the column according to FIG. 1.
Figure 3:
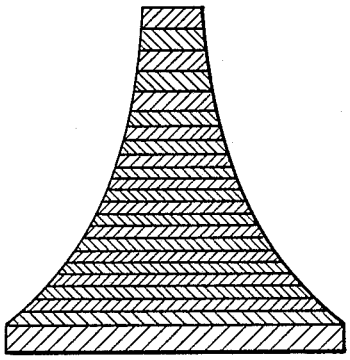
FIG. 3 shows a table pedestal made of a massive wooden column according to the invention.

With the modern technique of wood shaping it is possible to cut elements of very complicated shape out of flat wooden boards or laminate plates, and these elements may be reproduced in any desired number of specimen with a high precision. Thus, columns can be made up out of a plurality of such stacking elements, having an outer surface which is, without a special and expensive final treatment, sufficiently smooth for being directly painted. FIG. 1 shows a column 1 according to the invention serving to cover a support 2 having a double-T profile. The column is constituted here of a stack of identical rings, one of them, the ring 3, being shown in FIG. 2. The rings may be smooth at their outside surface or else be provided with grooves as is indicated in FIG. 2. They may all have the same size in order to build up a column according to FIG. 1, or they may have different diameters in order to constitute a trumpet-like central pedestal for a table as shown in FIG. 3. In this latter case, it may be useful to vary the thickness of the stacking elements and to provide a smaller thickness for regions with great variations in diameter, while thicker boards may be used for regions in which the diameter remains constant. By means of modern automatic cutting tools, there may also be realized inclined cutting surfaces such that the final column which is shown in FIG. 3 presents, without extensive final treatment, a continously varying profile.

While the construction of a massive column or a purely decorative column from the stacking elements does not present any major problem and may be performed completely in the factory, the column-like wainscoting according to FIG. 1 can be prepared in the factory by stacking and gluing rings and then by cutting the stack along a plane 4 (FIG. 1) which includes the axis of the column. The two parts of the column are then re-assembled by gluing around the column 2. As a variant, it is also possible to stack half-rings in the factory in order to manufacture half-columns, which method avoids the cutting of a column into two parts.

The invention is not restricted to the preferred embodiments shown in the drawings. Thus, modern cutting tools are able to manufacture more complicated annular elements from which oblique columns, columns with oval cross-sections, half-columns or columns with spiral ribs or zig-zag grooves can be assembled. Moreover, the flat boards from which the different elements of the column are obtained by cutting may themselves be derived from a laminate block. As a basic material, not only wood can be used, but also synthetic material in the form of plates. The columns obtained from this material are then adapted to be mounted in the open air. Compared to a column made of synthetic material and cast according to the state of the art (and necessitating large special casting recipients), the cross-section of the column according to the invention can be adapted to a custom design by simply modifying the digital programming of the automatic tool used for cutting the stacking elements out of plates of synthetic material.

I claim:

1. A method for manufacturing a hollow column used to wainscot a support in a building defining a column axis, comprising the steps of:

cutting out of flat wooden boards, laminate plates or plates made of synthetic material annular stacking elements, stacking and gluing said elements about a stacking axis, to form a hollow column, cutting said hollow column into two half-columns along a plane including the stacking axis and re-assembling said half-columns around the support and gluing said half-columns together along a plane which includes the stacking axis.

2. A method for manufacturing a hollow column used to wainscot a support in a building defining a column axis, comprising the steps of:

cutting out of flat wooden boards, laminate plates or plates made of synthetic material annular stacking elements, stacking and gluing said elements about a stacking axis, to form a hollow column, cutting said hollow column into at least two column sections along a plane including the stacking axis and re-assembling said at least two column sections around the support and gluing said at least two column sections together along planes which include the stacking axis.

* * * * *